US006168286B1

(12) United States Patent
Duffy

(10) Patent No.: US 6,168,286 B1
(45) Date of Patent: Jan. 2, 2001

(54) BRIM MOUNTED NOVELTY LIGHT FOR SPORTS CAPS

(76) Inventor: Paul J. Duffy, 53 Weymouth St., Holbrook, MA (US) 02343

( * ) Notice: Under 35 U.S.C. 154(b), the term of this patent shall be extended for 0 days.

(21) Appl. No.: 09/368,264

(22) Filed: Aug. 3, 1999

Related U.S. Application Data

(60) Provisional application No. 60/095,074, filed on Aug. 3, 1998.

(51) Int. Cl.[7] ..... F21L 11/00

(52) U.S. Cl. ..... 362/106; 362/105; 362/191; 362/190

(58) Field of Search ..... 362/105, 106, 362/191, 190

(56) References Cited

U.S. PATENT DOCUMENTS 4,406,040 * 9/1983 Cannone ..... 362/106
5,741,060 * 4/1998 Johnson ..... 362/106
5,921,674 * 7/1999 Koczi ..... 362/106

* cited by examiner

*Primary Examiner*—Sandra O'Shea
*Assistant Examiner*—Anabel M Ton
(74) *Attorney, Agent, or Firm*—John M. Brandt

(57) ABSTRACT

A novelty light for baseball style sports attachable to the brim of the cap and positioned to illuminate the front of the crown or head covering portion of the cap. A sports team insignia is preferably attached or attachable to the crown in the area of illumination. The light is arranged to flicker or flash on and off at a high rate and may be contained in a housing appropriate to the sport associated with the team insignia.

12 Claims, 3 Drawing Sheets

BRIM MOUNTED NOVELTY LIGHT FOR SPORTS CAPS

CROSS-REFERENCE TO RELATED APPLICATION

This application is based on the disclosure of provisional patent application Ser. No. 60/095,074 filed Aug. 3, 1998 by the same inventor.

BACKGROUND OF THE INVENTION

1. Field of the Invention

The invention resides in the field of novelty items for spectator sporting events and more particularly relates to a brim mounted light for baseball style caps.

2. Description of the Prior Art

Head mounted lamps whether attached to a headband or a cap are well known in the prior art. Specific examples include coal miners lamps and other such devices which are worn for the purpose of illuminating a work area while leaving the hands free.

Other more modern designs combine a battery powered light with a cap for the purpose of illuminating a smaller area more proximate to the wearer for reading written materials and the like. Examples of these are U.S. Pat. No. 5,741,060, Johnson; U.S. Pat. No. 5,667,292, Sabalvars; jr.; and U.S. Pat. No. D387,184 Seidmeyer. et al.

In either case, all of the designs known to applicant are arranged to illuminate areas in front of, to the side of, or below the lamp as worn. In contrast, the present invention is intended for a different purpose, that is, to illuminate the cap itself. Also in contrast to the prior art, the lamp is intend to blink or flicker at a rapid rate.

Both the direction of illumination to the front of the cap and the flickering or pulsating light beams are intended to create a novelty effect by calling attention to the wearer's support for a particular team at a sporting event. In use, each cap may be specifically identified with a particular team insignia at the illumination point. Additionally, the light may be encased in a container of a shape relating to the game being played such as a baseball, football or the like or alternatively may have a team insignia placed on the face of the container.

SUMMARY OF THE INVENTION

The invention may be summarized as a novelty light for sports caps and the combination thereof wherein a flashing or flickering light is mounted on the cap brim and arranged to illuminate the front of the crown or head covering portion. A sport team insignia is preferably mounted on the front of the cap to receive and reflect the light creating a strobe or flashing insignia effect. The insignia may either be permanently attached by sewing for example, or contained in a holder mounted on the cap or semi-permanently attached by for example two sided adhesive tape.

The light consists of at least one light emitting diode (LED), a source of electrical power, a small battery for example, an electrical circuit to activate the diode and produce a rapid on-off switching cycle to provide the flicker or strobe effect, and a housing for the diode, power source, and circuitry. The housing may be in the form of a sports implement appropriate to the game at which the cap is worn, a game ball such as a basketball, baseball or football for example. Means to attach the housing to the brim are also provided.

The features and advantages of the invention will be more fully understood from the description of the preferred embodiment and drawings which follow.

DESCRIPTION OF THE PREFERRED EMBODIMENT

Figure 1:
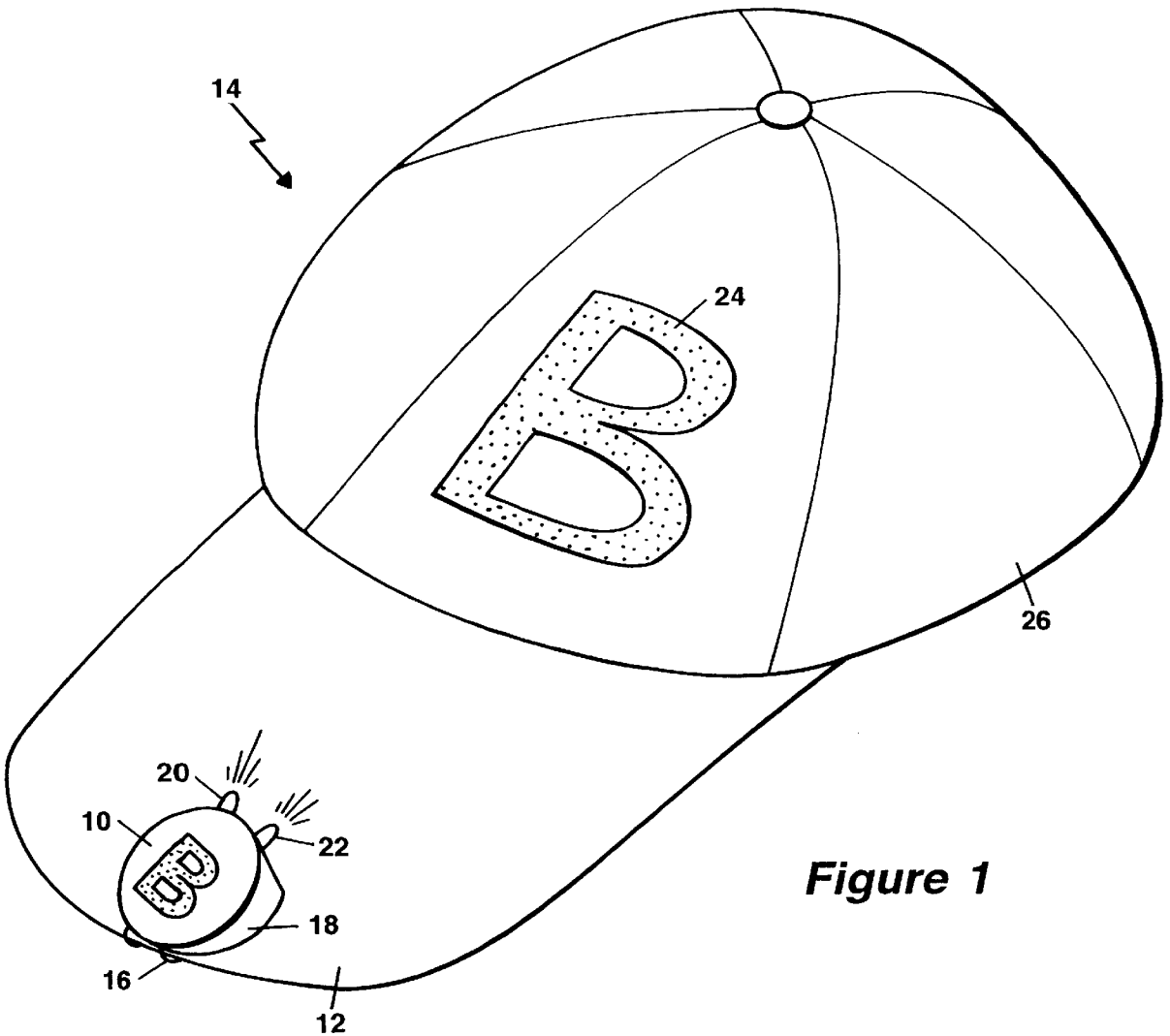
FIG. 1 is a perspective view of the preferred embodiment of the invention.

Referring first to FIG. 1, there is shown a perspective view of the preferred embodiment of the invention in which light 10 is mounted to brim 12 of cap 14 by clip 16. Housing 18 contains a source of power, an on/off switch, and an integrated circuit (I/C) for creating pulsed power for light emitting diodes (LED) 20 and 22. While one LED is sufficient for the invention, the pair as illustrated will provide a wider field of illumination as well as redundancy. The LED's are positioned so as to illuminate insignia 24 on cap crown or head covering portion 26.

Figure 2:
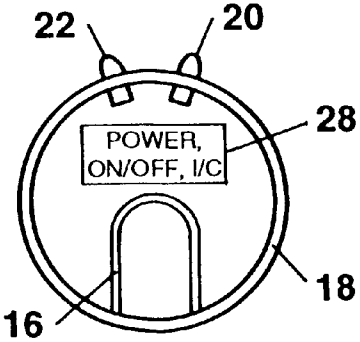
FIG. 2 is bottom view of one component of the embodiment of FIG. 1.
Figure 3:
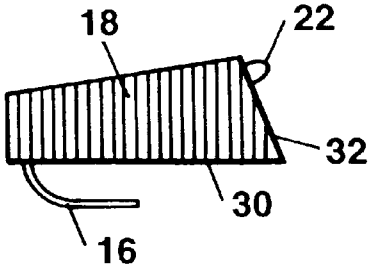
FIG. 3 is a side view of the component of FIG. 2.
Figure 4:
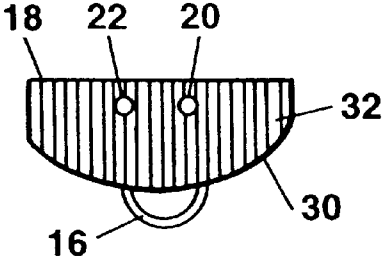
FIG. 4 is a front view of the component of FIG. 2.

FIG. 2, 3, and 4, are bottom, side, and front views of light 10 wherein like numerals refer to like components. In FIG. 2, the power, on/off switch, and I/C flashing circuit are illustrated schematically as unit 28 mounted inside housing 18 and may be purchased in its entirety from Allegro Electronics, Freedmont, Calif.

FIG. 3 illustrates the configuration of clip 16 which serves to detachably mount housing 18 to brim 12. Also shown is a preferred configuration of cylindrical housing 18 in which bottom 30 forms an oblique angle with housing surface 32 to provide an elevated angle for LED's 20 and 22 to enhance the illumination of insignia 24.

Figure 5:
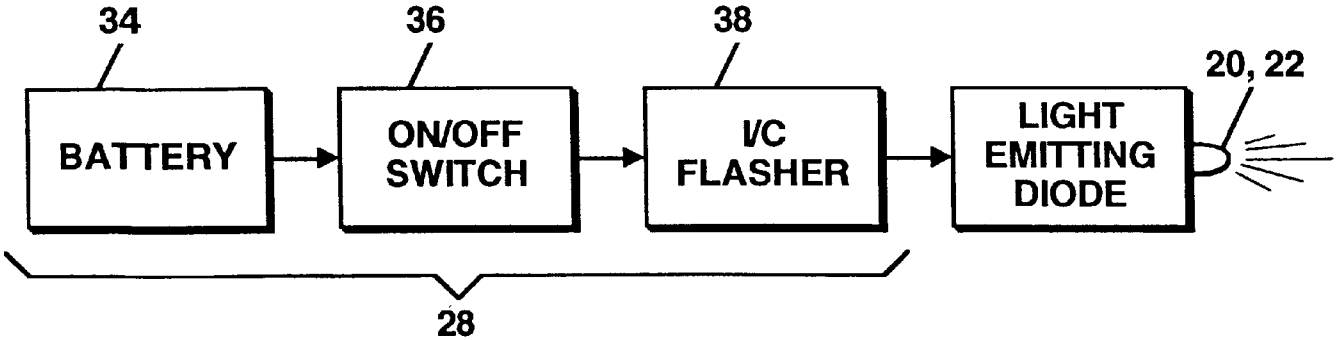
FIG. 5 is a block diagram of the circuitry of component of FIG. 2.

FIG. 5 is a schematic circuit diagram of commercially available unit 28 showing the successive connection of battery 34, on/off switch 36, and I/C flasher 38 to diode(s) 20 and 22.

Figures 6, 7:
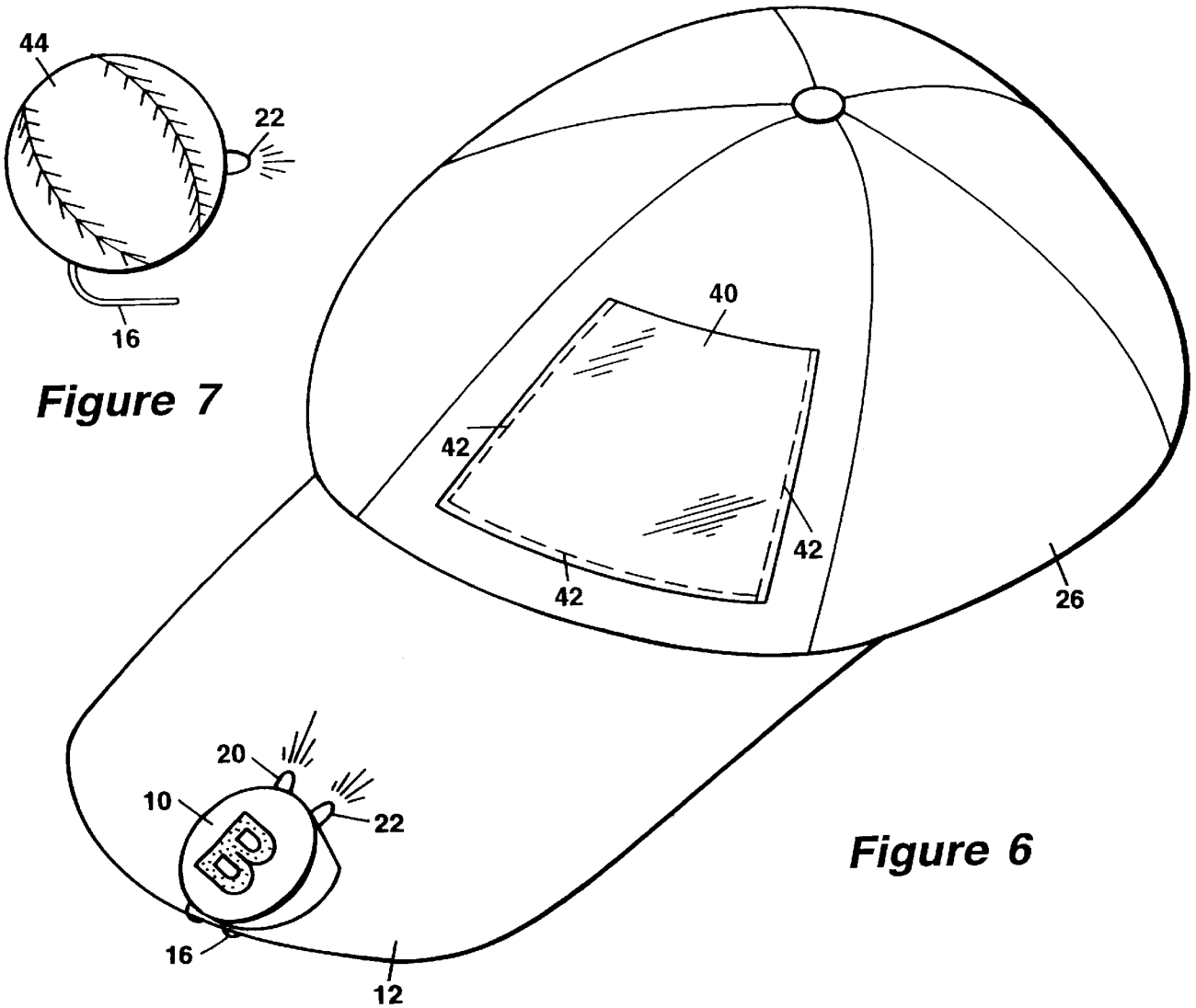
FIG. 6 is a perspective view of an alternate structure of the embodiment of FIG. 1.
FIG. 7 is a perspective view of an alternative structure of the embodiment of FIG. 2.

FIG. 6 illustrates an alternative arrangement of the combination of light and cap in which an insignia holder is attached to crown 26 to replace a permanently attached insignia 24. The holder may be advantageously consist of a clear plastic envelope attached by for example a rivet or a single sheet of plastic 40 sewn to three sides by for example seams 42.

Finally FIG. 7 shows a holder in the form of a sports implement, i.e., a baseball 44. The light functions exactly the same as in the above described embodiment.

As variations in the above described embodiment will now be apparent to those skilled in the art, the invention is accordingly defined by the following claims.

What is claimed is:

1. A novelty light for a sports cap having a brim and a head covering portion and an insignia mounted on the front of said head covering portion comprising in combination:

A. At least one light emitting diode;

B. electrical power means for powering said diode;

C. electrical circuit means for activating said diode and causing said diode to emit light at a selected flashing rate;

D. a cylindrical housing for mounting said diode, and containing said power means, and said electrical circuit means; and E. mounting means for mounting said housing on said brim in a position to illuminate said insignia with said light emitting diode.

2. The apparatus of claim 1 wherein the bottom of said cylinder forms an oblique angle with the surface.

3. The apparatus if claim 1 wherein said mounting means comprises a wire clip.

4. The apparatus of claim 1 wherein said housing is in the form of a sports implement.

5. The apparatus of claim 1 wherein said selecting flashing rate is seven to ten times per second.

6. A sports cap and novelty light comprising:

A. a sports cap brim;

B. a sports cap head covering portion attached to said brim, said portion having a front, a back and two sides;

C. at least one light emitting diode;

D. electrical power means for powering said diode;

E. electrical power means for activating said diode and causing said diode to emit light at a selected flashing rate;

F. a housing for containing said diode, said power means and said electrical means; and G. mounting means comprising a wire clip for mounting said housing on said brim in a position to illuminate said front of said head covering portion.

7. The apparatus of claim 6 where in said housing is cylindrical, and said light emitting diode is mounted on the surface thereof.

8. The apparatus of claim 1 where in the said bottom of said cylinder forms an oblique angle with the surface.

9. The apparatus of claim 6 wherein said front has sport team insignia mounting means attached thereto.

10. The apparatus of 6 further including a sport team insignia attached to said front.

11. The apparatus of claim 6 wherein said housing is in the form of a sports implement.

12. The apparatus of claim 6 wherein said flashing rate is seven to ten times a second.

* * * * *